US005533601A

United States Patent [19]

Wang

[11] Patent Number: 5,533,601

[45] Date of Patent: Jul. 9, 1996

[54] HIDDEN TYPE RETRACTABLE HANDLE ASSEMBLY FOR A SUITCASE

[76] Inventor: King-sheng Wang, No. 17, Lane 116, Ta An Gan Rd., Tachia Chen, Taichung Hsien, Taiwan

[21] Appl. No.: 502,193

[22] Filed: Jul. 13, 1995

[51] Int. Cl.[6] ..... A45C 5/00; A45C 13/22

[52] U.S. Cl. ..... 190/115; 190/39; 190/111; 16/115; 150/108; 150/110; 383/14

[58] Field of Search ..... 190/18 A, 39, 190/101, 111, 115, 117, 118; 150/101, 102, 110, 108, 117; 16/115; 383/14

[56] References Cited

U.S. PATENT DOCUMENTS

| | | | |
|---|---|---|---|
| 1,074,133 | 9/1913 | Neustaedter | 190/115 X |
| 1,495,752 | 5/1924 | La Rue | 190/115 X |
| 2,518,973 | 8/1950 | Atherton | 190/115 X |
| 4,139,084 | 2/1979 | Linke | 190/111 X |
| 4,733,549 | 3/1988 | Baker | 190/115 X |
| 4,792,025 | 12/1988 | Thomas | 190/115 X |
| 5,048,649 | 9/1991 | Carpenter et al. | 190/115 X |
| 5,167,306 | 12/1992 | Carrigan, Jr. | 190/115 X |
| 5,335,759 | 8/1994 | Yeh | 190/115 |
| 5,375,685 | 12/1994 | Plath | 190/115 X |
| 5,482,147 | 1/1996 | Wang | 190/115 |

FOREIGN PATENT DOCUMENTS

| | | | |
|---|---|---|---|
| 22665 | 11/1936 | Australia | 190/101 |
| 823486 | 11/1952 | Germany | 190/115 |
| 590028 | 7/1977 | Switzerland | 190/115 |

*Primary Examiner*—Sue A. Weaver
*Attorney, Agent, or Firm*—Peterson, Wicks, Nemer & Kamrath

[57] ABSTRACT

A handle assembly is provided for a suitcase having first and second half bodies and includes a bracket fixedly mounted in an opening defined in a top wall of the first half body. A hidden base is fixedly received in the bracket and has two legs each respectively extending through the bracket. Two outer tubes each have an upper end securely mounted around a corresponding one of the two legs and rested on an underside of the bracket. Two inner tubes each are slidably mounted in a corresponding one of the two outer tubes and each have an upper end slidable in a corresponding one of the two legs to be slidably received in a recess defined in the hidden base. A handle portion is received in the recess and has two distal ends each fixedly mounted on the upper end of a corresponding one of the two inner tubes. A cap is pivotally mounted on the hidden base for enclosing the recess.

2 Claims, 5 Drawing Sheets

HIDDEN TYPE RETRACTABLE HANDLE ASSEMBLY FOR A SUITCASE

BACKGROUND OF THE INVENTION

FIELD OF INVENTION

The present invention relates to a hidden type retractable handle assembly, and more particularly to a hidden type retractable handle assembly for a suitcase.

RELATED PRIOR ART

A conventional retractable handle assembly is disposed outside of a suitcase, thereby being not able to afford a hidden type handle assembly which is disposed inside the suitcase.

The present invention has arisen to mitigate and/or obviate disadvantages of the conventional handle assembly.

SUMMARY OF THE INVENTION

The primary objective of the present invention is to provide a hidden type retractable handle assembly.

In accordance with one aspect of the present invention, there is provided a handle assembly for a suitcase which comprises first and second half bodies each having a top wall and a side wall. An opening is defined in the top wall of the first half body, and two snapping bosses are formed on an upper portion of the side wall thereof.

The handle assembly comprises a bracket fixedly mounted on the top wall of the first half body and having an underside received in the opening. Two holes each are defined in the underside of the bracket and each communicate with the opening.

A hidden base is fixedly received in the bracket and has first and second elongated sides, two opposite short sides and an underside. Two legs each are formed on the underside of the hidden base and each respectively extend through a corresponding one of the two holes and each have a wedge-shaped block laterally protruding outwardly therefrom. Two passages each are vertically defined in a corresponding one of the two legs. A recess is defined in the hidden base and communicates with each of the two passages.

Two hook portions each are laterally formed on the first elongated side of the hidden base and each securely snap on the upper portion of the side wall of the first half body. Two pivot axles each are formed on a corresponding one of the two hook portions and face toward each other. Two cavities each are defined in a corresponding one of the two opposite short sides of the hidden base and each communicate with the recess.

Two outer tubes each have an upper end which is securely mounted around a corresponding one of the two legs and is rested on the underside of the bracket and has a wedge-shaped cavity defined therein for fixedly receiving the associated wedge-shaped block therein. Two inner tubes each are slidably mounted in a corresponding one of the two outer tubes and each have an upper end extending through a corresponding one of the two passages to be slidably received in the recess. A handle portion is received in the recess and has two distal ends each fixedly mounted on the upper end of a corresponding one of the two inner tubes.

A cap is pivotally mounted on the hidden base for enclosing the recess and has first and second elongated sides and two opposite short sides. Two ears each are laterally formed on the first elongated side of the cap and each have a socket horizontally defined therein for receiving a corresponding one of the two pivot axles such that the cap is pivotally engaged with the hidden base about the two pivot axles.

Two snapping blocks each are laterally formed on a corresponding one of the two opposite short sides of the cap and each are detachably received in a corresponding one of the two cavities of the hidden base. Two retaining bores each are defined in the cap and each detachably receive a corresponding one of the two snapping bosses therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
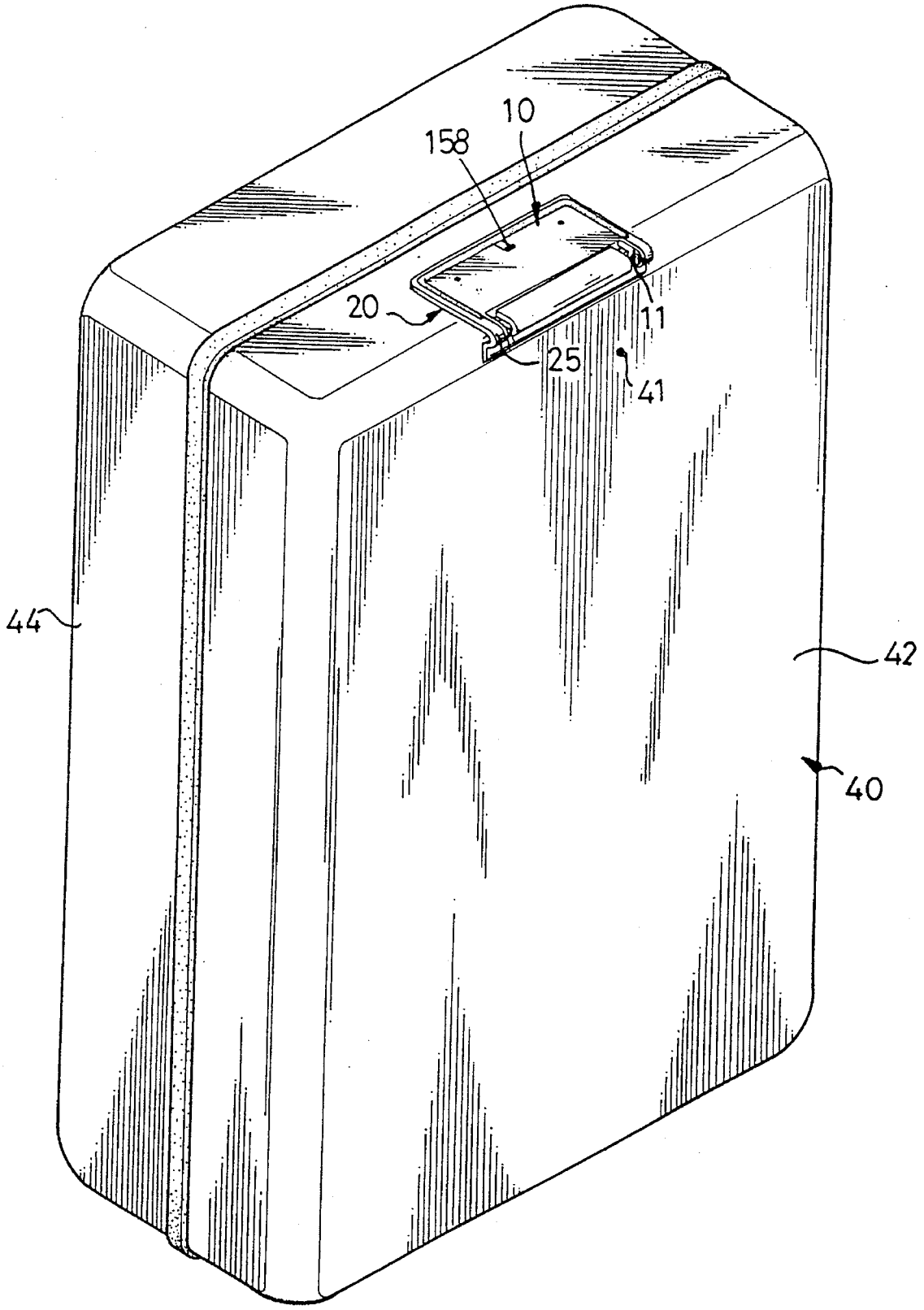
FIG. 1 is a perspective view of a retractable handle assembly for a suitcase in accordance with the present invention.
Figure 2:
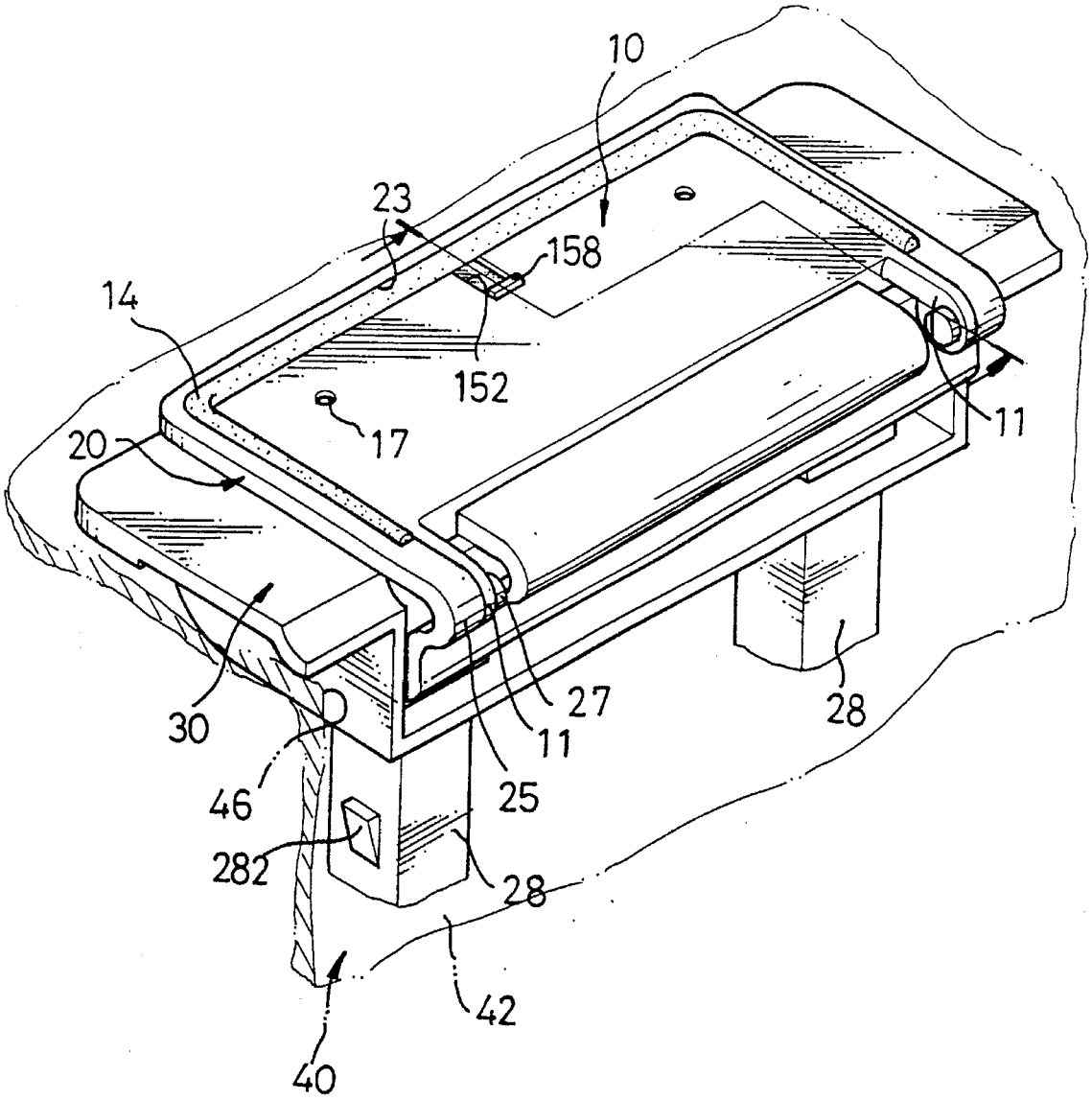
FIG. 2 is an enlarged partially cross-sectional perspective view of the handle assembly as shown in FIG. 1.

Referring to the drawings, and initially to FIGS. 1 and 2, a hidden type retractable handle assembly in accordance with the present invention is provided for a suitcase 40 which comprises first and second half bodies 42 and 44 each having a top wall and a side wall. An opening 46 is defined in the top wall of the first half body 42, and two snapping bosses 41 are formed on an upper portion of the side wall of the first half body 42.

Figure 3:
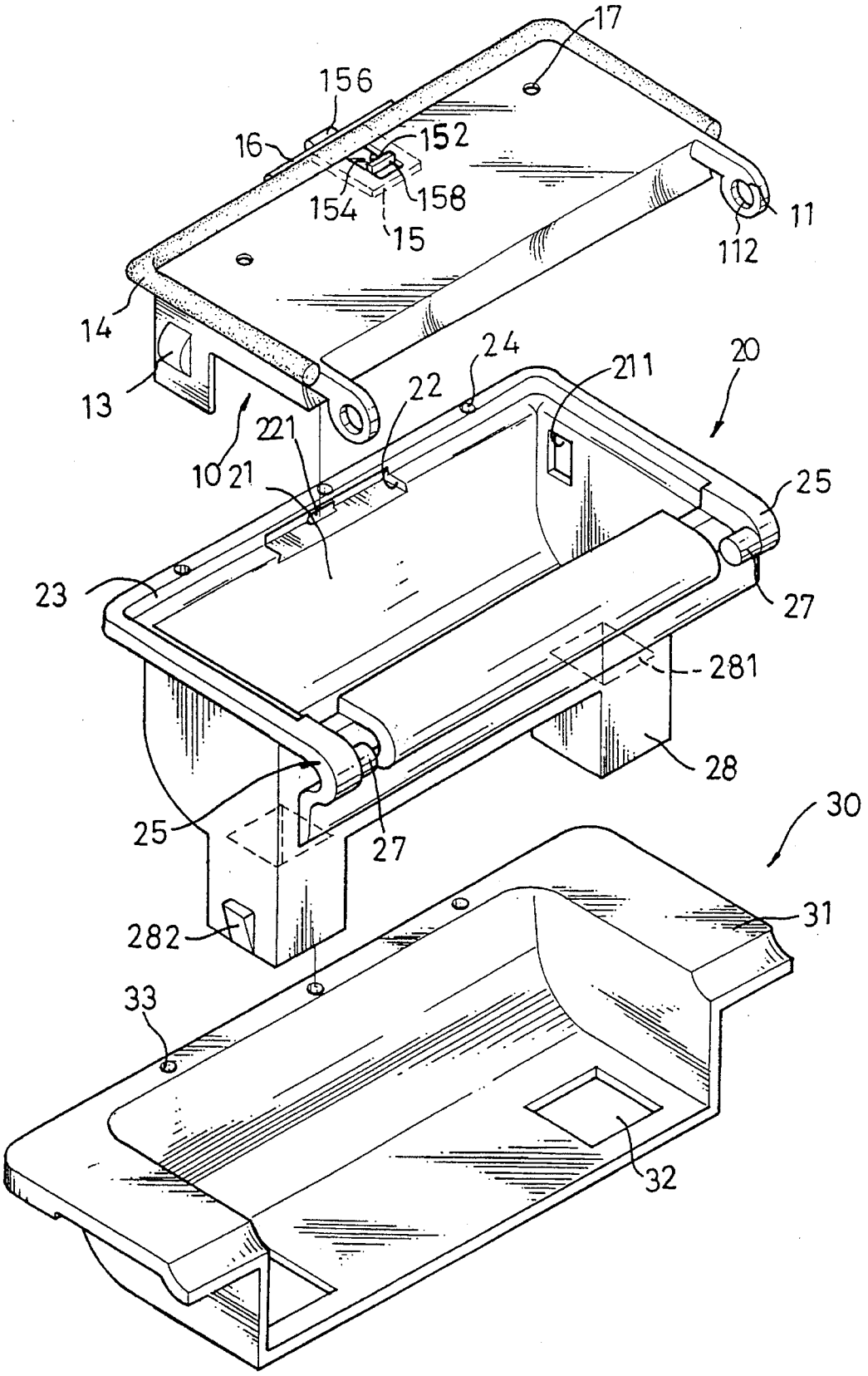
FIG. 3 is partially exploded view of the handle assembly.
Figure 4:
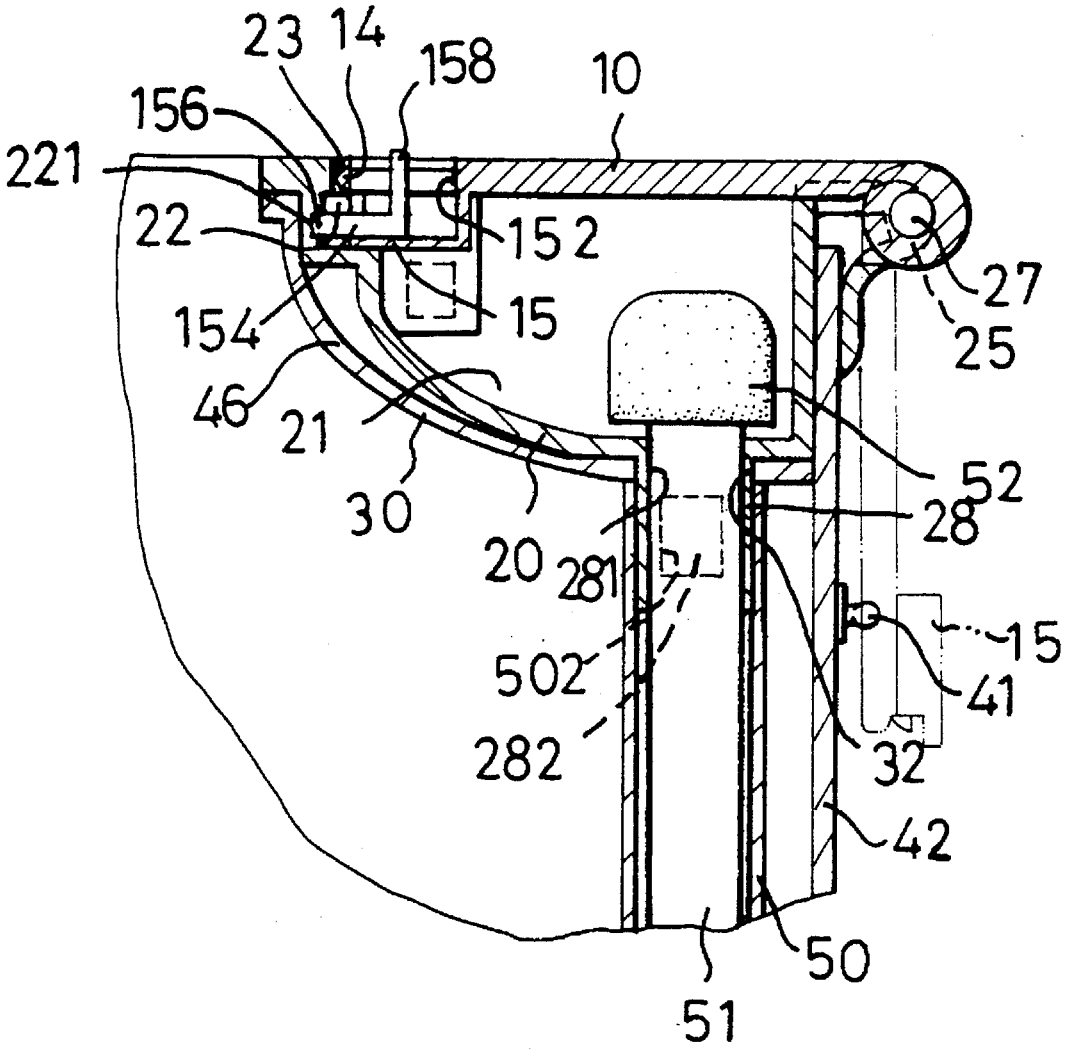
FIG. 4 is a side cross-sectional assembly view of the handle assembly.

Referring to FIGS. 2–4, the handle assembly comprises a bracket 30 fixedly mounted on the top wall of the first half body 42 and having a flat border 31 smoothly supported on the top wall and an underside received in the opening 46. A plurality of circular holes 33 are respectively defined in the flat border 31. Two holes 32 each are defined in the underside of the bracket 30 and each communicate with the opening 46.

A hidden base 20 is fixedly received in the bracket 30 and has first and second elongated sides, two opposite short sides and an underside. Two legs 28 each are formed on the underside of the hidden base 20 and each respectively extend through a corresponding one of the two holes 32 and each have a wedge-shaped block 282 laterally protruding outwardly therefrom. Two passages 281 each are vertically defined in a corresponding one of the two legs 28. A recess 21 is defined in the hidden base 20 between the first and second elongated sides thereof and between the two opposite short sides thereof and communicates with each of the two passages 281.

Two hook portions 25 each are laterally formed on the first elongated side of the hidden base 20 and each securely snap on the upper portion of the side wall of the first half body 42. Two pivot axles 27 each are formed on a corresponding one of the two hook portions 25 and facing with each other. Two cavities 211 each are defined in a corresponding one of the two opposite short sides of the hidden base 20 and each communicate with the recess 21.

A plurality of circular holes 24 each are defined in the second elongated side of the hidden base 20 and each communicate with a corresponding one of the circular holes 33 of the bracket 30 such that the hidden base 20 together with the bracket 30 is fixed to the top wall of the first half body 42 by means of such as rivets (not shown).

Two outer tubes 50 each have an upper end securely mounted around a corresponding one of the two legs 28 and rested on the underside of the bracket 30 and having a wedge-shaped cavity 502 defined therein for fixedly receiving the associated wedge-shaped block 282 therein.

Two inner tubes 51 each are slidably mounted in a corresponding one of the two outer tubes 50 and each have an upper end extending through a corresponding one of the two passages 281 to be slidably received in the recess 21. A handle portion 52 is received in the recess 21 and has two distal ends each fixedly mounted on the upper end of a corresponding one of the two inner tubes 51 to move upwardly and downwardly therewith.

A cap 10 is pivotally mounted on the hidden base 20 for enclosing the recess 21 and has first and second elongated sides and two opposite short sides. Two ears 11 each are laterally formed on the first elongated side of the cap 10 and each have a socket 112 horizontally defined therein for receiving a corresponding one of the two pivot axles 27 therein such that the cap 10 is pivotally engaged with the hidden base 20 about the two pivot axles 27.

Two snapping blocks 13 each are laterally formed on a corresponding one of the two opposite short sides of the cap 10 and each are detachably received in a corresponding one of the two cavities 211 of the hidden base 20. Two retaining bores 17 each are defined in the cap 10 and each detachably receive a corresponding one of the two snapping bosses 41 therein.

A depression 23 is defined in the hidden base 20 along an inner periphery thereof for receiving a resilient edge 14 therein which is formed on the cap 10 along an outer periphery thereof. A retaining indent 22 is defined in the second elongated side of the hidden base 20 and communicates with the depression 23 for receiving an elongated block 16 therein which is formed on the second elongated side of the cap 10.

A positioning notch 221 is defined in the second elongated side of the hidden base 20 and communicates with the retaining indent 22. A lug portion 15 (see FIGS. 3–5) is formed on the second elongated side of the cap 10. An elongated slot 152 is defined in the lug portion 15 and communicates with the positioning notch 221.

A positioning member 154 is slidably mounted in the elongated slot 152 and has a stop 156 formed on a distal end thereof and projecting outwards of the cap 10. A control piece 158 is formed on the positioning member 154 and is slidable in the elongated slot 152 between a first position where the stop 156 is received in the positioning notch 221, thereby fixing the cap 10 on the hidden base 20, and a second position where the stop 156 is detached from the positioning notch 221 such that the cap 10 is pivoted to the hidden base 20.

Figure 5:
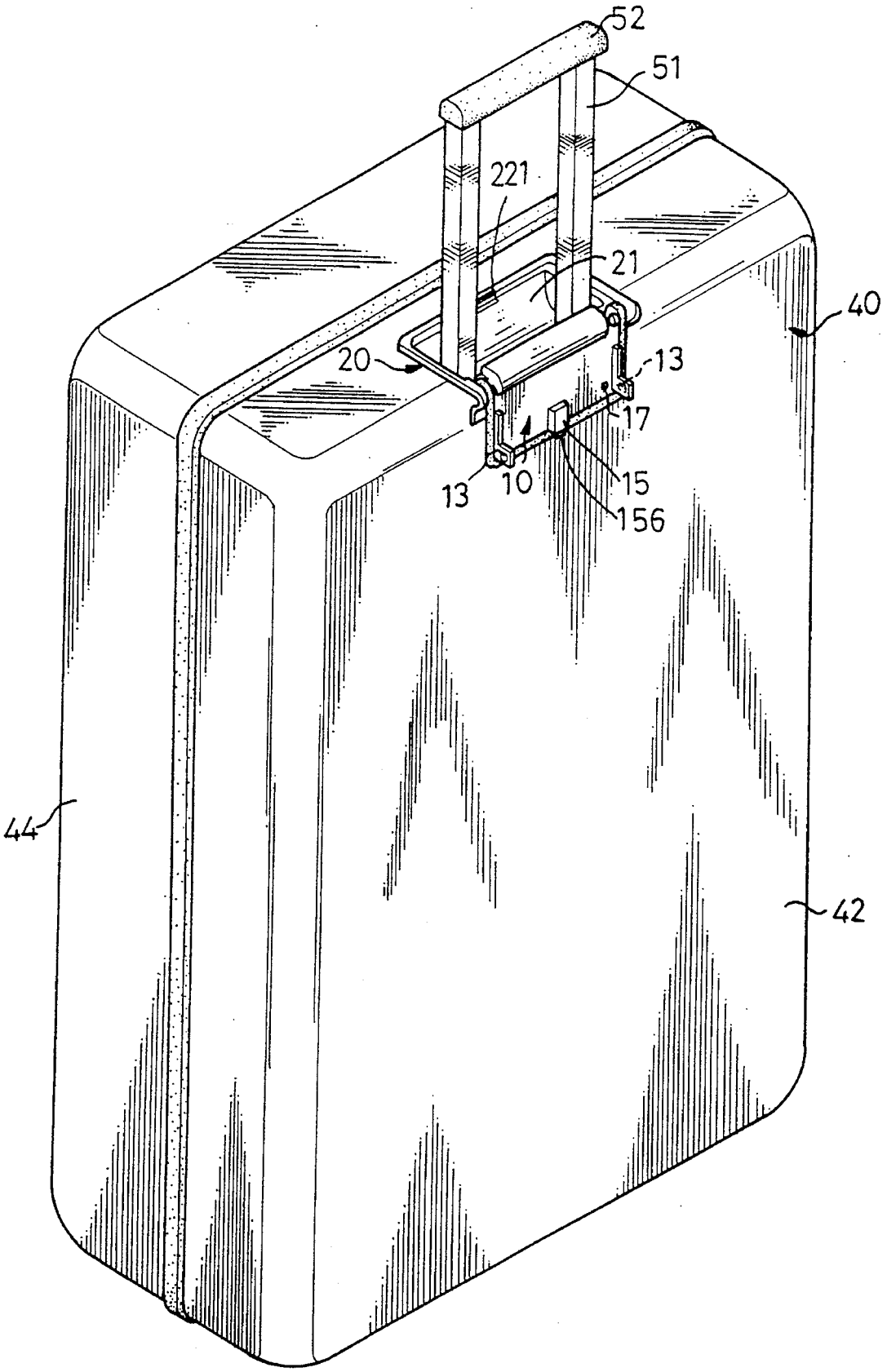
FIG. 5 is an operational view of the handle assembly.

In operation, referring to FIGS. 1 and 4–5, the cap 10 is initially mounted on the hidden base 20 with the stop 156 locked in the positioning notch 221 such that the handle portion 52 together with the two inner tubes 51 is received in the hidden base 20, thereby providing a hidden type handle assembly. When the stop 156 is released from the positioning notch 221, the cap 10 is able to pivot relative to the hidden base 20 about the pivot axles 27 and is able to displace to rest on the side wall of the first half body 42 with the snapping bosses 41 received in the retaining bores 17, thereby positioning the cap 10 on the side wall of the first half body 42.

Then, the handle portion 52 together with the two inner tubes 51 is able to extend through the recess 21 to move upwardly, thereby expanding and stretching the handle assembly as shown in FIG. 5.

The, handle portion 52 together with the two inner tubes 51 is able to move downwardly to be received into the recess 21 of the hidden base 20 when not in use. Then, the cap 10 is able to pivot about the pivot axles 27 with the snapping bosses 41 being detached from the retaining bores 17 and is able to be securely mounted on the hidden base 20 with the stop 156 being locked in the positioning notch 221 again, thereby folding the handle assembly.

It should be clear to those skilled in the art that further embodiments of the present invention may be made without departing from the teachings of the present invention.

What is claimed is:

1. A handle assembly for a suitcase (40) which comprises first and second half bodies (42) and (44) each having a top wall and a side wall, an opening (46) defined in the top wall of said first half body (42), and two snapping bosses (41) formed on an upper portion of the side wall of said first half body (42), said handle assembly comprising:

a bracket (30) fixedly mounted on the top wall of said first half body (42) and having an underside received in said opening (46), two holes (32) each defined in the underside of said bracket (30) and each communicating with said opening (46);

a hidden base (20) fixedly received in said bracket (30) and having first and second elongated sides, two opposite short sides and an underside, two legs (28) each formed on the underside of said hidden base (20) and each respectively extending through a corresponding one of said two holes (32) and each having a wedge-shaped block (282) laterally protruding outwardly therefrom, two passages (281) each vertically defined in a corresponding one of said two legs (28), a recess (21) defined in said hidden base (20) between said first and second elongated sides thereof and between said two opposite short sides thereof and communicating with each of said two passages (281), two hook portions (25) each laterally formed on the first elongated side of said hidden base (20) and each securely snapping on the upper portion of the side wall of said first half body (42), two pivot axles (27) each formed on a corresponding one of said two hook portions (25) and facing with each other, two cavities (211) each defined in a corresponding one of the two opposite short sides of said hidden base (20) and each communicating with said recess (21);

two outer tubes (50) each having an upper end which is securely mounted around a corresponding one of said two legs (28) and is rested on the underside of said bracket (30) and has a wedge-shaped cavity (502) defined therein for fixedly receiving associated said wedge-shaped block (282) therein;

two inner tubes (51) each slidably mounted in a corresponding one of said two outer tubes (50) and each having an upper end extending through a corresponding one of said two passages (281) to be slidably received in said recess (21);

a handle portion (52) received in said recess (21) and having two distal ends each fixedly mounted on the upper end of a corresponding one of said two inner tubes (51); and a cap (10) pivotally mounted on said hidden base (20) for enclosing said recess (21) and having first and second elongated sides and two opposite short sides, two ears (11) each laterally formed on the first elongated side of said cap (10) and each having a socket (112) horizontally defined therein for receiving a corresponding one of said two pivot axles (27) such that said cap (10) is pivotally engaged with said hidden base (20) about said two pivot axles (27), two snapping blocks (13) each laterally formed on a corresponding one of the two opposite short sides of said cap (10) and each detachably received in a corresponding one of said two cavities (211) of said hidden base (20), and two retaining bores (17) each defined in said cap (10) and each detachably receiving a corresponding one of said two snapping bosses (41) therein.

2. The handle assembly in accordance with claim 1, wherein a positioning notch (221) is defined in the second elongated side of said hidden base (20), a lug portion (15) is formed on the second elongated side of said cap (10), an elongated slot (152) is defined in said lug portion (15) and communicates with said positioning notch (221), a positioning member (154) is slidably mounted in said elongated slot (152) and has a stop (156) formed on a distal end thereof, a control piece (158) is formed on said positioning member (154) and is slidable in said elongated slot (152) between a first position where said stop (156) is received in said positioning notch (221) and a second position where said stop (156) is detached from said positioning notch (221).

* * * * *